US005630404A

United States Patent [19]

Regazzi et al.

[11] Patent Number: 5,630,404

[45] Date of Patent: May 20, 1997

[54] SELECTIVELY POWER FEEDING DEVICE FOR ELECTRICAL LOADS AND THE IGNITION CIRCUIT OF INTERNAL COMBUSTION ENGINES, IN MOTOR-VEHICLES

[75] Inventors: Gianni Regazzi, Bologna; Astorre Biondi, S.G.Persiceto; Beniamino Baldoni, Bologna, all of Italy

[73] Assignee: Ducati Energia S.p.A., Bologna, Italy

[21] Appl. No.: 547,628

[22] Filed: Oct. 24, 1995

[51] Int. Cl.[6] ..... F02P 3/06

[52] U.S. Cl. ..... 123/602

[58] Field of Search ..... 123/602, 418, 123/416, 600; 307/106

[56] References Cited

U.S. PATENT DOCUMENTS

| | | | |
|---|---|---|---|
| 4,478,200 | 10/1984 | Nagashima et al. | 123/605 |
| 4,537,174 | 8/1985 | Nagasawa | 123/604 |
| 4,672,941 | 6/1987 | Yamagata | 123/602 |
| 4,679,540 | 7/1987 | Abe et al. | 123/602 |
| 4,722,311 | 2/1988 | Erhard | 123/418 |
| 4,739,185 | 4/1988 | Lee et al. | 307/106 |
| 4,809,661 | 3/1989 | Kinoshita et al. | 123/418 |
| 4,887,581 | 12/1989 | Okuda | 123/602 |
| 4,924,831 | 5/1990 | Piteo et al. | 123/417 |
| 5,069,193 | 12/1991 | Erhard | 123/602 |

FOREIGN PATENT DOCUMENTS

| | | | |
|---|---|---|---|
| 0597352 | 5/1994 | European Pat. Off. | 123/602 |
| 0601460 | 6/1994 | European Pat. Off. | 123/602 |
| 58-211563 | 12/1983 | Japan | 123/602 |

*Primary Examiner*—Raymond A. Nelli
*Attorney, Agent, or Firm*—Young & Thompson

[57] ABSTRACT

A device for selectively feeding electrical power to loads and the ignition circuit of internal combustion engine of a motor-vehicle; a single power generating winding of an electric generator is selectively connectable, via differently polarized diodes and electronic switch means to the ignition circuit of the engine and to A.C and D.C. electrical load circuits respectively, under the control of a voltage regulator comprising the electronic switches of the electrical-load circuit, and a control unit designed to selectively supply the voltage output from the generator, to the electrical-load circuit for part of the electrical voltage period of the generator and to the ignition circuit of the engine for the remaining part of the aforementioned period, respectively.

6 Claims, 4 Drawing Sheets

SELECTIVELY POWER FEEDING DEVICE FOR ELECTRICAL LOADS AND THE IGNITION CIRCUIT OF INTERNAL COMBUSTION ENGINES, IN MOTOR-VEHICLES

BACKGROUND OF THE INVENTION

The present invention relates to an electrical system for equipping motor vehicles, designed to selectively feed both the alternating-current and direct-current electrical loads and the electrical ignition circuit of the engine, respectively.

STATE OF THE ART

A basic electrical system for a motor vehicle such as a low-powered motor vehicle, typically comprises a first circuit means for feeding the alternating-current and direct-current loads, provided with a voltage regulator, and second circuit means for feeding the ignition circuit of the combustion engine, which first and second circuits means are fed by independent or separate coils of a same magneto-generator.

This solution is chosen when it is not desired to have all the electrical loads of the system and the said, ignition circuit of the combustion engine bound by or dependent upon the presence of a battery which in this type of vehicle is always very small and generally is used only for occasional feeding of the loads, for example at the start-up or for the directional lights of the vehicle itself.

A typical electrical power supply system for motor vehicles, together with its mode of operation, is schematically shown in the FIGS. 1 and 2 of the accompanying drawings.

The system substantially comprises an electric generator G consisting of a stator 10 and a magnetic rotor 11 in a manner known per se. The stator 10 generally comprises several power windings formed by various coils, for example a winding L1, consisting of about 3,000 to 4,000 turns of a very thin wire, for feeding an ignition circuit CDI of the capacitive-discharging type, and by two serially connected windings L2, L3 for feeding the alternating-current and direct-current loads L and B; the ignition circuit CDI schematically consists of the ignition capacitor Cl connected to the winding L1 of the generator via the diode D2, and also connected to the primary winding of the high-voltage coil T1, the secondary winding of which feeds the spark plug CD. The ignition circuit, in the example, comprises moreover a branched-off diode D1 as well as an electronic switch SCR3, the control electrode of which is connected to a trigger coil L4 which provides a triggering signal for synchronization with the operating cycle of the internal combustion engine.

The load circuit comprises, on the other hand, a winding L2 consisting of one or more coils formed by several hundred turns of a wire of greater thickness, intended to feed the alternating-current loads represented, for example, by the lamp L, and also comprises a third winding L3, consisting in turn of one or more coils of similar dimensions to the winding L2, intended to feed the direct-current loads, for example the electric battery B, and a combined voltage regulator 12, respectively, consisting of two sections, i.e. an alternating-current section comprising the electronic switch SCR1 for regulating the voltage VL to electrical loads L, and a direct-current section comprising the electronic switch SCR2 for regulating the voltage VB of the battery B. A single control circuit U1 is supplied at its two voltage inlet I1, I2, respectively, with the voltages VL and VB of the alternating-current and direct-current loads and provides in turn at its outlets E1 and E2 the control signals for the two electronic switches SCR1 and SCR2.

Briefly, the operation mode of the circuit shown in FIGS. 1 and 2 is as follows: the winding L1 provides the current necessary for charging the capacitor C1 via the diode D2 during the positive half-waves, while the negative half-waves are short-circuited by the diode D1. When the winding L4 provides a triggering signal for operation of the ignition circuit, SCR3 is triggered and the capacitor Cl is discharged onto the high-voltage coil T1 for the generation of a spark on the spark plug CD.

At the same time as operation of the ignition circuit, operation of the feeding circuit for the loads occurs: the alternating-current section A.C. of the regulator 12 measures the rated value of the voltage VL applied to the lamp L and, when this voltage exceeds a preset value, the control circuit U1 of the voltage regulator turns-on the SCR1 which short-circuits the winding L2 of the generator for the whole of the negative half-wave from the time t1 when SCR1 was triggered, until the time t2 when the current in SCR1 is zero and the voltage VL applied to the load L, corresponding to that at the terminals of the winding L2 of the generator, becomes positive again.

In practice the rated value on the load L is obtained by a partialization of the negative half-wave of the generator, i.e. by causing conduction of the switch SCR1 after a certain angle $\alpha 1$, as schematically shown in the graph of FIG. 2 which shows the voltage Vo of the generator applied to the load L if the regulating system were not present. Since the windings L2 and L3 of the generator have their own inductance, once the switch SCR1 intervenes, it remains under conduction for an angle $\alpha 2$ defined by the internal characteristics of the said generator, where $\alpha 1$ plus $\alpha 2$ is greater than 180° electric, but less than 360° electric, in the manner shown. All this is linked by the relation:

w $L_G/R$ where, in the case of a resistive load:

$w=2\pi f$, where:

f is the electrical frequency of the generator;

R is the equivalent resistance of the load, plus that of the generator;

$L_G$ is the internal inductance of the generator.

From what has been said it is obvious that the angle $\alpha 3$ relating to the remaining fraction of the period of the generator voltage has a sinusoid fraction which feeds the alternating-current load L and which in practice cannot be controlled by this type of regulator, thus resulting in limitations as regards the value of the minimum load which can be fed with the generator itself. In practice all of this results in the fact that the regulator cannot regulate the voltage on the loads if the latter do not possess an equivalent high resistance, greater than a certain value. For example, a permanent-magnet generator with a nominal power of 100 W (A.C.) at the speed of 6000 rpm regulated to the nominal voltage of 13.5 V, with the regulator of the aforementioned type, at the speed of 10,000 rpm has a voltage of 16 V (rated) on a resistive load of 10 W, and it is therefore obvious that the voltage regulator cannot manage to maintain the nominal voltage of the vehicle circuit on loads of 10 W or less where there is clearly a higher voltage of 13.5 V (nominal).

And this represents a very significant limitation inherent in regulating circuits of the known type because it prevents one from using generators with a power above a set value and loads less than a given value. In other words, the regulator of this known circuit regulates only a fraction of the power generated, typically 90%, while the remaining 10% of the power which is available and cannot be controlled, forms a limit for the minimum load applicable to the generator.

On the other hand, operation of the direct-current section of the voltage regulator is very simple: the control circuit U1 reads the voltage VB of the battery and if this voltage is less than a desired value, activates the switch SCR2, allowing the current to flow for charging the battery when the voltage VL3 at the ends of the set of windings L2, L3 is positive; otherwise the electronic switch SCR2 remains deactivated.

Since the windings L2 and L3 of the generator are in series and in phase with each other, it is obvious that the two sections, the alternating-current section and the direct-current section of the voltage regulator 12 will be influenced by each other, in particular the alternating-current section, and hence the voltage VL on the load L will be affected by the fact as to whether the switch SCR2 is ON or OFF; this represents a second imitation of the conventional load feed circuit.

Last but not least, a third limitation of this solution lies in the very complex structure of the generator, owing to the multiplicity of windings and associated connecting cables.

A solution which provides a limited number of connections between the generator and the ignition circuit and which makes use of a single generator winding performing the dual function of feeding the electronic ignition circuit of the engine and the load circuit of the vehicle, is illustrated for example in the patent U.S. Pat. No. 4,537,174. However, in this solution also, use is made of a mixed alternating-current and direct-current regulating system which nevertheless reveals the minimum-load problems mentioned previously.

OBJECTS OF THE INVENTION

The object of the present invention is to provide a device for feeding the loads and the ignition circuit of an internal combustion engine in motor vehicles, designed to overcome these drawbacks, providing a solution whereby it is possible to eliminate the problem of the minimum load applicable to the generator by controlling the output power during the entire period of operation of the generator.

A further object of the present invention is to provide a device for feeding the loads and the ignition circuit of a combustion engine of vehicles in general, in particular for motor vehicles or low-powered motor vehicles, whereby any negative influences between the section feeding the alternating-current loads and the section feeding the direct-current loads of the said device are eliminated, permitting moreover extreme constructional and functional simplification of the same generator.

Yet another object of the present invention is to provide a device for feeding the loads, particularly suitable for use with an ignition circuit of the capacitive-discharge type which uses a high voltage responsive system for feeding the ignition itself, for example as described and claimed in a previous patent application IT MI92 A 2809 in the name of the same Applicant, which is briefly illustrated in the description which follows.

The present invention, therefore, provides a device for selectively feeding the electrical loads and the ignition circuit of a motor-vehicle combustion engine, comprising a single power generating coil of an electric generator which can be selectively connected, via differently polarized diodes and electronic switches to the ignition circuit of the engine and to the circuit of the electrical alternating-current and direct-current loads, respectively, under the control of a voltage regulator comprising semi-conductor switching devices in the electrical-load circuit; and a control unit designed to selectively supply the voltage output from the generator to the electrical-load circuit for part of the electrical voltage period of the generator and to the ignition circuit of the engine for the remaining in part of the aforementioned period, respectively.

BRIEF DESCRIPTION OF THE DRAWINGS

The general principles of the present invention as well as the differences with respect to the prior art will be understood more clearly hereinbelow with reference to the accompanying drawings, in which.

DETAILED DESCRIPTION OF THE INVENTION

Figure 1:
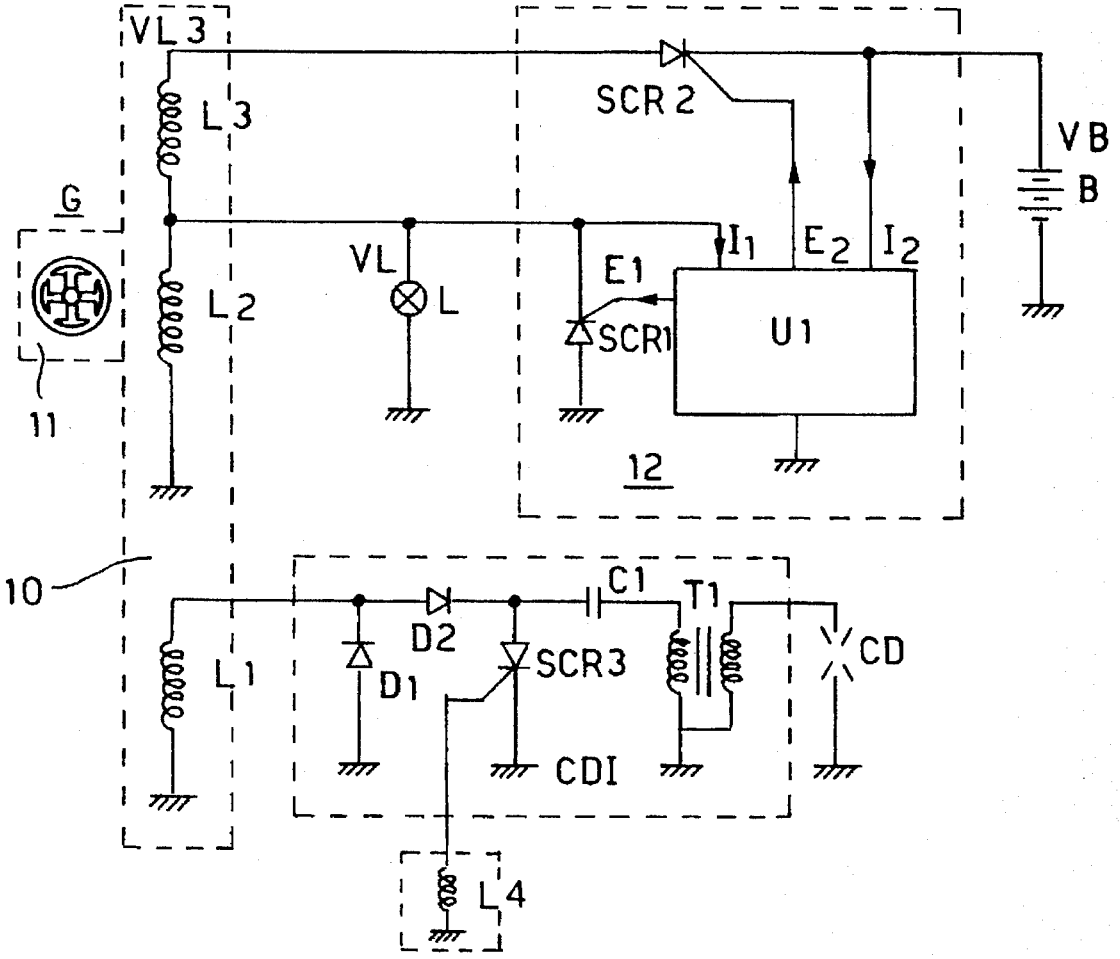
FIG. 1 shows the diagram of a conventional electrical system.
Figure 2:
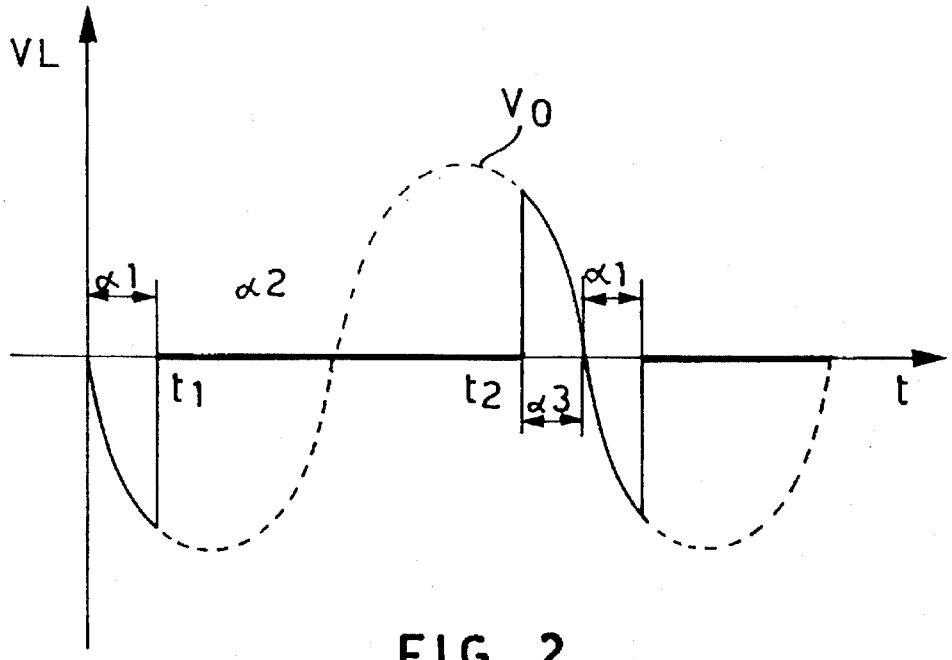
FIG. 2 is a graph which shows the voltage feeding the alternating-current loads, in relation to the non-regulated voltage of the generator, for the winding feeding the alternating-current loads.

As mentioned previously, FIGS. 1 and 2 of the accompanying drawings illustrate the state of the prior art described above, in accordance with which the system has separate circuits for the engine ignition and for feeding the alternating-current and direct-current loads of the vehicle.

Figure 3:
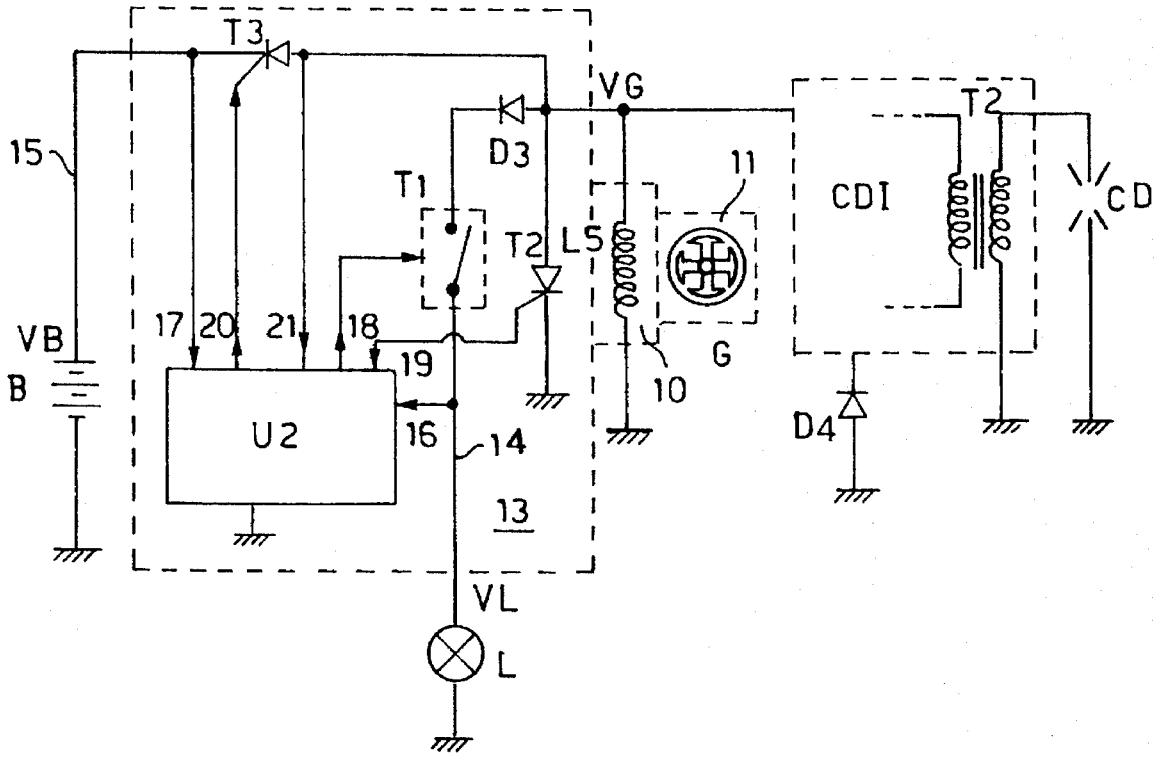
FIG. 3 is a diagram of a circuit feeding the loads and the ignition system of a combustion engine, according to the invention.

With reference to FIG. 3 now we shall illustrate instead a solution according to the present invention designed to overcome the drawbacks inherent in the previous systems.

The solution according to FIG. 3 comprises a single power winding generating coil L5 of the generator G which may distributed on one or more coils wound onto the various pole pieces of the stator 10, which is connected to the circuit 14 of the alternating-current load L of the motor vehicle, via a directly polarized diode D3 and an electronic switch T1 which can be opened and closed, while it is connected to the ignition circuit CDI for the engine spark-plug CD via a diode D4 inversely polarized with respect to the preceding diode D3.

More precisely, the feeding circuit 14 for the lamp L, forming the alternating-current load, and the feeding circuit 15 for the battery B, forming a direct-current load, comprise a mixed direct-current and alternating-current voltage regulator 13 having a first electronic switch T1, for example a power MOS in series with the circuit 14 feeding the lamp L, and a second electronic switch T2, for example an SCR for short-circuiting to earth the winding L5 of the generator G as well as a third electronic switch T3, for example an SCR connected in series to the battery B. If T1 were able to perform the function of blocking the current from the load to the generator, then the diode D3 could be eliminated. During operation, the diode D3 and the electronic switches T1, T2 and T3 allow the flow of current from the generator to the A.C. and D.C. loads only when the voltage $V_G$ of the generator is positive.

The voltage VL present on the A.C. load and the voltage VB present on the battery B are sent to the control inlets 16 and 17, respectively, of a control unit U2 which, via its outlets 18, 19 and 20, feeds the control electrodes of the electronic switches T1, T2 and T3, respectively. The control circuit U2, shown in FIG. 9, is suitably designed to command the opening and closing sequences of the various electronic switches, so as to regulate selectively the voltages and the distribution of the electric power to the various loads L, B and to the engine ignition circuit CDI, as explained further below.

Figure 9:
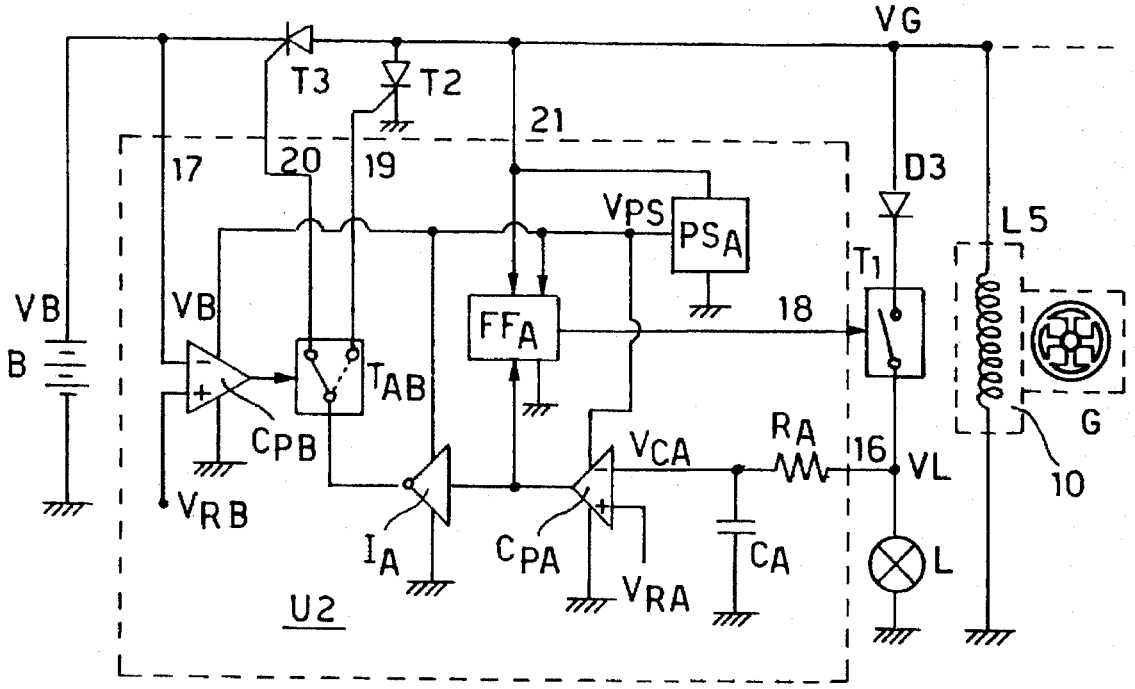
FIG. 9 is an example of a voltage regulator.

An example of a control circuit U2 is shown in FIG. 9; according to the example of FIG. 9, the control circuit U2 comprises a first voltage comparator $C_{PA}$, the inverting inlet of which is supplied with a voltage $V_{CA}$ provided by a capacitor $C_A$ branched downstream of the resistor RA forming a time delay circuit connected to the voltage $V_L$ feeding the alternating-current load L. The non-inverting outlet of $C_{PA}$ is supplied with a first reference voltage $V_{RA}$. In turn, the outlet of the first voltage comparator $C_{PA}$ is sent to an inlet of the interface FFA connected to the control electrode of the electronic switch T1, at another inlet 21 of which it receives the voltage $V_G$ of the generator 10.

The output of the first voltage comparator $C_{PA}$ is moreover sent, via a signal invert $I_A$ and an electronic changeover switch $T_{AB}$, to the control electrode of the electronic switch T2 or T3, respectively; the switching conditions of $T_{AB}$ are controlled by a second voltage comparator $C_{PB}$, the output of which is fed to the control inlet of $T_{AB}$; in turn, the voltage comparator $C_{PB}$ is supplied at its inverting inlet with the battery voltage $V_B$, while it is supplied at its non-inverting inlet with a second reference voltage $V_{RB}$.

Finally, $PS_A$ in FIG. 9 denotes the feeding circuit for the various electronic devices of the control unit U2, while the same references as in FIG. 3 have been used for the corresponding parts.

Figure 4:
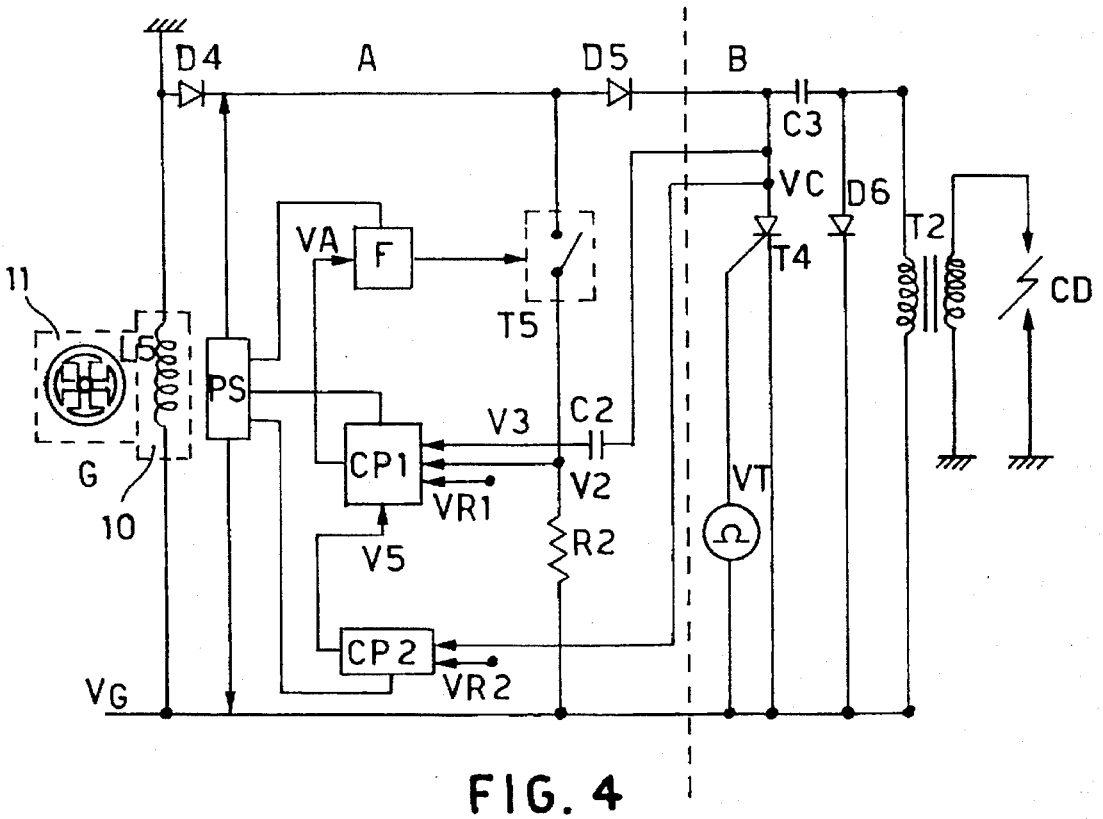
FIG. 4 shows a specific solution of a capacitive-discharge ignition circuit, of the high voltage responsive type, which can be used with the circuit shown in FIG. 3.

With reference to FIG. 4, for the sake of a complete description of the invention, we shall describe by way of example the basic circuit of a capacitive-discharge ignition device comprising an upgraded system for charging the ignition capacitor which uses a high voltage induced in the winding of the generator, caused by the rapid interruption of a short-circuiting current obtained by triggering in rapid succession the opening and closing conditions of a switch forming part of a voltage booster.

In FIG. 4, A denotes the feeding part for the charging circuit B of the ignition capacitor C3; in particular, the part A of the circuit comprises the winding L5 of the alternating-current generator G shown in the example in FIG. 3.

In the example shown, the charging circuit B for the capacitor C3 is connected to the primary winding of the ignition coil T2, via the diodes D4 and D5; the circuit comprises moreover an electronic switch T4 which causes discharging of the capacitor C3 onto the ignition coil T2, in accordance with a timing signal VT supplied by an appropriate coil of the voltage generator, or in another manner known per se, and also comprises a diode D6 for recirculating the current of the primary winding of the high-voltage coil T2.

In turn, the part A supplying the charging voltage to the capacitor C3 is connected to the winding L5 of the voltage generator, via the diode D4 which allows the generator current to flow towards the ignition circuit only when the voltage $V_G$ of the generator is negative; the part A of the circuit comprises a voltage booster for rising voltage fed to C3, consisting for example of an electronic switch T5 and a resistor R2 which can be connected in parallel to the generator G; the resistor R2, or other equivalent circuit, supplies to an inlet of a voltage comparator CP1 a voltage V2 of the voltage booster, which is proportional to the current flowing across the electronic switch T5, so as to control by means of the output voltage VA and the interface F the opening and closing condition, in rapid succession, of the switch itself. In fact, the rapid opening and closing of the electronic switch T5 makes it possible to obtain charging of the capacitor C3 to a substantially constant voltage value, independently of the output voltage from the generator G and the operating condition of the engine. Opening and closing conditions of switch T5 are triggered by the voltage comparator CP1 which is supplied at its inlets with the voltage V2, indicative of the current flowing across the switch T5, with a working voltage V3 supplied by a capacitor C2, suitable for maintaining an operating status of the comparator CP1, or via another device designed to provide a derived function of the increase of the voltage VC of the capacitor C3 during each individual partial charging phase of the capacitor itself, as well as a reference voltage VR1 indicative of the maximum level of the voltage V2 and hence the maximum current of the switch T5 with respect to which the comparator CP1 trigger opening and closing conditions, in rapid succession, of the switch T5.

CP2 denotes moreover a device for inhibiting CP1, suitable for defining the maximum level of the voltage VC for C3 and consisting for example of a second voltage comparator which continuously compares the voltage VC of the capacitor C3 with a second reference voltage VR2 so as to prevent operation of CP1 and keep T5 closed when VC reaches or tends to exceed the maximum level permitted for the charging voltage of the ignition capacitor C3. Therefore, the output V5 of CP2 is sent to a control inlet of CP1 for the purpose mentioned above. Finally PS denotes schematically a feeding circuit for the various operating units of the power supply system for the electronic ignition shown.

The principle on which the circuit shown in FIG. 4 is based consists in transforming the energy accumulated by the inductance of the winding L5 of the voltage generator G, into electrical energy for charging the ignition capacitor C3. The above is obtained by short-circuiting, i.e. opening and closing in rapid succession the switch T5, causing rapid current variations which produce a high voltage induced in the winding L5 of the generator, which is consequently used for charging the capacitor C3 independently of the value of the output voltage of the generator itself which, as is known, varies in accordance with the variation in the number of revolutions of the engine.

Figure 5:
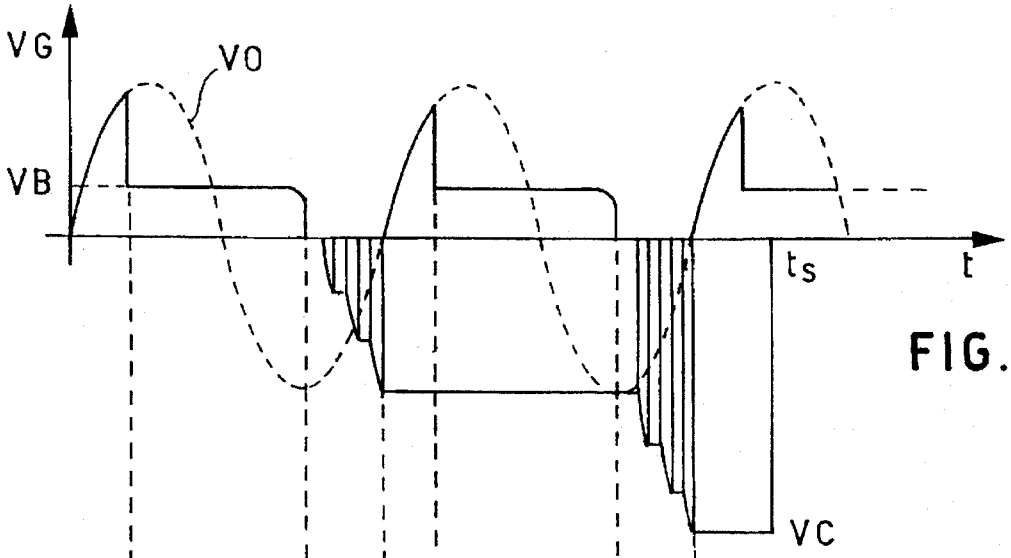
FIG. 5 shows the waveform of the generator voltage and the battery voltage in relation to the voltage of the ignition capacitor in the case where the battery has a voltage value less than a desired charging value.

With reference again to FIGS. 3 and 9 and the graphs shown in FIGS. 5, 6, 7 and 8, the operating mode of the device will be now described; from FIG. 5 it will be noted that when the voltage VG on the anode of D3 starts to rise, the switch T1 is closed by the control circuit U2 and hence the lamp L or other alternating-current load is supplied with a voltage Vl, and therefore is circulated by a current IL for a certain period of time corresponding to an electric angle α1 suitable for providing an appropriate rated value of the voltage itself, typically 13.5 V. More precisely, when the voltage $V_G$ of the generator starts to become positive then, with T1 being closed or ON, the voltage VL on the load L also increases. This also involves an increase in the voltage $V_{CA}$ on the capacitor $C_A$ connected to the inverting inlet of the voltage comparator $C_{PA}$ which will compare the voltage $V_{CA}$ with the reference voltage $V_{RA}$.

The voltage $V_{CA}$ will reach the value $V_{RA}$ with a certain delay compared to $V_L$, determined by the value of the time constant $A=R_A C_A$; this time delay determines the angle α1 at which voltage is applied to the load L, the rated value of the voltage $V_L$ depending on the ratio of the electric degrees α1/360°. If $V_{CA}$ is greater or equal to $V_{RA}$ then the output of $C_{PA}$ will switch from high to low; the interface $FF_A$ will recognize this transition and via the outlet 18 will open the electronic switch T1.

This condition is maintained for the whole of the angle α2, i.e. until $V_G$ becomes positive; the polarity of $V_G$ is recognized via the inlet 21.

Figure 6:
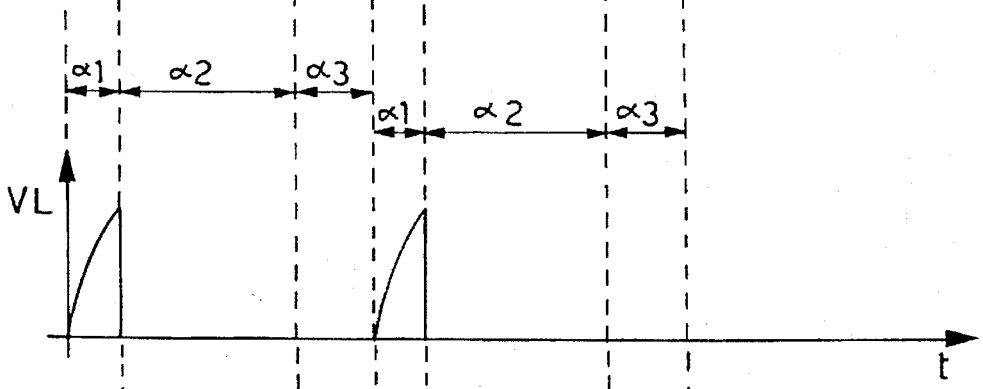
FIG. 6 shows the voltage on the alternating-current load.
Figure 7:
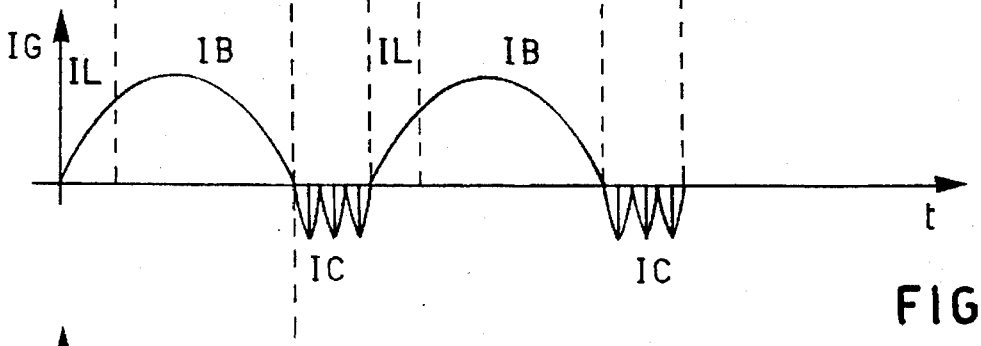
FIG. 7 shows the output current of the generator.

During this phase, the switches T2 and T3 are open or OFF; therefore, the waveform of the voltage VL applied to the alternating-current load and the respective current IL are shown in the FIGS. 6 and 7 of the accompanying drawings.

After this first phase, following termination of the angle α1 relating to the alternating-current section of the regulator, two situations are possible: the first one where the battery B has a voltage value VB lower than the value of the reference voltage $V_{RB}$ corresponding to the desired discharge voltage, typically 13.5 V; in this case T1 is opened and the deviator $T_{AB}$ is switched to the outlet 20 so that the switch T3 is made to conduct, while T2 remains open. In this way the battery B is supplied with a current IB (FIG. 7) for a period of time equivalent to an electric angle α2 dependent upon the inductance of the same generator. During the time period relating to the angle α3, the electronic switches T1, T2 and T3 are brought back into their initial state with T1 closed, and T2, T3 open, ready for the next period.

Since the generator G always has its own 20. inductance, conduction of the current feeding the loads will always occur for an angle α1+α2 greater than 180° electric, for each period of the generator voltage; as a result, it is possible to make adequate use of the energy provided by the generator to feed the alternating-current and direct-current loads of the vehicle's electrical system, i.e. this is possible since ignition of the combustion engine requires a limited power, of the order of about 5–10 Watts.

In the second case, however, if the voltage $V_B$ of the battery B supplied to the inverting inlet of CPB exceeds the value of the reference voltage $V_{RB}$, TAB is switched to the outlet 19, causing conduction of T2 while T1 and T3 remain open; in this case, after closing of T2, the condition of T1 and T3 is uninfluential since T2 short-circuits the generator G to earth. This condition is illustrated in the graph shown in FIG. 8, where it can be noted that the voltage and hence the current on the load n alone occurs for the angle α1.

The last phase is that relating to the angle fraction α3 of the negative half-wave fraction of each electric period of the generator which is involved only for feeding the voltage booster of the capacitive-discharge ignition circuit described in the example in FIG. 4. During the time period relating to the angle α3, the interface $FF_A$, detecting via the inlet 21, that the voltage of the generator $V_G$ is negative with respect to earth restores the initial state of the electronic switch T1, causing it to conduct, while T2, T3 are inhibited.

Figure 8:
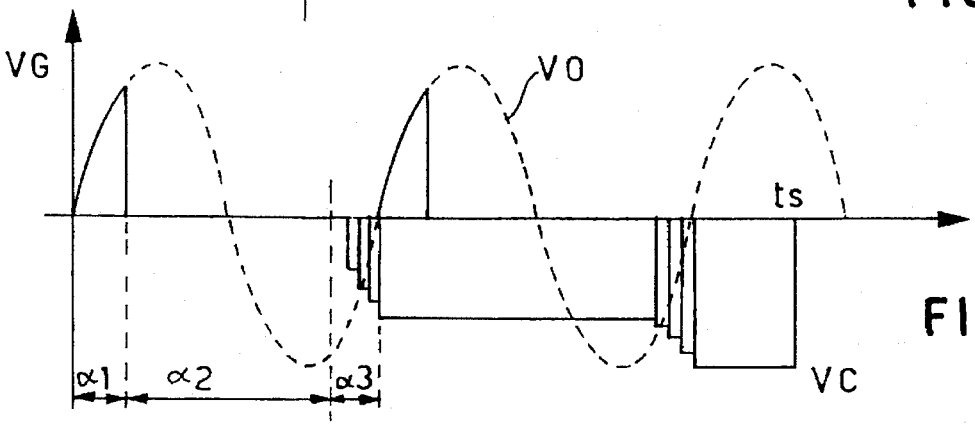
FIG. 8 shows the output voltage of the generator which in this case coincides with the voltage VL on the alternating-current capacitor, in relation to the non-regulated voltage Vo of the generator and the voltage on the ignition capacitor, when the battery voltage is greater than a predetermined value.

FIGS. 5 and 8 show in both cases the waveform of the voltage VC on the ignition capacitor, up to the instant ts of the spark which, as shown, occurs when the generator voltage is positive; in this way the electronic switch T4 is prevented from short-circuiting the generator 10.

FIG. 7 shows, at α3, the waveform for the current IC of the generator during each fraction for charging of the ignition capacitor.

The output of the comparator $C_{PA}$, after T1 has been opened and T2 or T3 have started to conduct, since the capacitor $C_A$ discharges via $R_A$ and the load L, will switch from low to high and hence the output of $I_A$ from high to low, restoring the initial state.

From the above description and illustrations with reference to the accompanying drawings, it will therefore be understood that it has been possible to provide a system for supplying the voltage to the alternating-current and direct-current loads of a motor-vehicle installation, characterized in that use is made of a single winding of the generator, preferably distributed equally over all the stator poles and connected to the load voltage regulator and to the ignition circuit of the engine, respectively, via suitable polarized diodes, in combination with semi-conductor switching devices controlled by a control circuit designed to selectively supply the power output from the generator to the electrical load circuits of the motor-vehicle installation and to the engine ignition circuit, respectively, at specific instants of each period of the generator voltage, directing most of the energy generated for feeding the loads and instead only a small fraction for feeding the engine ignition circuit. In this way the problems associated with a minimum load are entirely eliminated since the residual fraction of the energy generated, for each period of the generator voltage, which previously could not be controlled in any way, is now explicitly destined for the engine ignition, without influencing the electrical loads equipping the vehicles, which in this case can be supplied with suitable voltage and current levels, independently of the nominal power of the loads and the generator.

What is claimed is:

1. A feeding device for feeding the alternating-current and direct-current electrical loads and for feeding the capacitive-discharge ignition circuit of a motor-vehicle combustion engine, comprising an electric generator one winding of which can be connected to the feeding circuit of electrical loads of the vehicle and to said ignition circuit, respectively, said winding of the generator being selectively connectable, via differently polarized diodes and electronic swith devices to the engine ignition circuit and to the electrical loads circuits of the vehicle, respectively, under the control of a voltage regulator, said voltage regulator comprising said electronic switch devices serially connected to the said electrical-load circuits and parallelly connected to the generator respectively, and a control circuit to selectively feed power from the generator to said electrical-load circuits with positive voltage out-goings for a part of each period of the alternating voltage of the generator, and to feed with the engine ignition circuit with negative voltage out-going for the remainder of the aforementioned period, respectively.

2. A device according to claim 1, in which the voltage-regulator is designed to open and close said switching devices for selectively feeding a positive voltage to the alternating-current load circuit for an initial part of the positive half-wave in each period of the generator voltage.

3. A device according to claim 2, in which the continuous-current load circuit comprises a power supply battery, characterized in that, depending on the charging condition of the battery, the control circuit is provided to allow connection of said winding of the voltage generator to the battery charging circuit via a first electronic switch and to the earth of the electrical circuit of the motor vehicle respectively via a second electronic switch, sequentially after the alternating-current load circuit has been fed.

4. A device according to claim 1, in which said voltage regulator comprises a first voltage comparator supplied at its inlets with a first reference voltage and with a voltage proportional to the generator voltage applied to the alternating-current load, respectively, the outlet of the said first voltage comparator and the voltage output from the generator being fed to respective inlets of a control interface for an electronic switch serially connected to the alternating-current load;

the outlet of said first voltage comparator being moreover fed to the control electrodes of an electronic switch for the short-circuiting to the earth of the generator, and of an electronic switch serially connecting the battery to the generator, respectively, via a signal inverter and an electronic switch-over device;

and in which there is provided a second voltage comparator connected to the control inlet of said switch-over device, send second voltage comparator being supplied at its inlets with the voltage of the direct-current load and with a second reference voltage, respectively.

5. A device according to claim 1, in which said engine ignition circuit is of the type comprising voltage boostering means for the ignition capacitor charging voltage, comprising the inductance of the generator winding and an electronic switch for short-circuiting the current in the said generator winding, and logic control means programmed for repeatedly opening and closing said short-circuiting switch causing rapid interruptions of the current flowing in the generator winding and in the same electronic short-circuiting switch.

6. A device according to claim 5, in which the voltage generator comprises a phase sensing means for emitting a timing signal to cause the discharging of the ignition capacitor in timing relation with operative cycle of the combustion engine, characterized by comprising circuit means for causing the emission of said discharge signal for the ignition capacitor during a positive half-wave going of the generator voltage.

* * * * *